US006317096B1

(12) United States Patent
Daginnus et al.

(10) Patent No.: US 6,317,096 B1
(45) Date of Patent: Nov. 13, 2001

(54) ANTENNA SYSTEM

(75) Inventors: Michael Daginnus; Mehran Aminzadeh, both of Braunschweig; Georg Bucksch, Lamspringe; Walter Denn; Meinolf Schafmeister, both of Bad Salzdetfurth, all of (DE)

(73) Assignee: FUBA Automotive GmbH, Bad Salzdetfurth (DE)

( * ) Notice: Subject to any disclaimer, the term of this patent is extended or adjusted under 35 U.S.C. 154(b) by 0 days.

(21) Appl. No.: 09/386,542

(22) Filed: Aug. 30, 1999

(51) Int. Cl.[7] ..... H01Q 13/00

(52) U.S. Cl. ..... 343/786; 343/712; 343/756; 343/757

(58) Field of Search ..... 343/786, 712, 343/713, 756, 757, 759, DIG. 2, 700 MS; 342/140, 158; 455/98, 99, 101, 103

(56) References Cited

U.S. PATENT DOCUMENTS

| | | | | |
|---|---|---|---|---|
| 4,725,843 | * | 2/1988 | Suzuki et al. | 343/714 |
| 5,061,936 | * | 10/1991 | Suzuki | 343/713 |
| 5,245,348 | | 9/1993 | Nishikawa et al. | 342/359 |
| 5,349,360 | | 9/1994 | Matsui | 342/374 |
| 5,398,035 | * | 3/1995 | Densmore et al. | 343/786 |
| 5,774,087 | * | 6/1998 | Rose | 342/158 |
| 5,835,057 | * | 11/1998 | Van Heyningen | 343/757 |
| 6,061,022 | * | 5/2000 | Menegozzi et al. | 342/140 |
| 6,070,071 | * | 3/2000 | Chavez et al. | 455/101 |

FOREIGN PATENT DOCUMENTS

| | | | |
|---|---|---|---|
| 41 42 403 | 12/1990 | (DE) | G01S/5/02 |
| 0 452 970 | 10/1991 | (EP) | H01Q/1/32 |
| 0 540 124 | 5/1993 | (EP) | H01Q/1/32 |
| 0 810 685 | 12/1997 | (EP) | H01Q/1/32 |
| 0 647 976 | 4/1995 | (EP) | H01Q/21/06 |
| 0 072 312 | 2/1983 | (EP) | H01Q/21/20 |
| 0 668 627 | 8/1995 | (EP) | H01Q/25/00 |
| 07-111416 | 4/1995 | (JP) | H01Q/13/22 |

OTHER PUBLICATIONS

Chujo et al. (1992) "Conformal Array Antenna for Mobile Satellite Communications", Electronics and Communications in Japan, Part 1, vol. 75(12), pp. 97–108.

Chujo et al. (1992) "Spherical Array Antenna Using Digital Beamforming Techniques for Mobile Satellite Communications", Electronics and Communications in Japan, Part 1, vol. 75(6), pp. 76–86.

Kawakami et al. (1995) "Circularly Polarized Conical Beam Antennas", "Circularly Polarized Conical Beam Antennas", Electornics and Communications in Japan, Part 1, vol. 78(5), pp. 66–79.

* cited by examiner

*Primary Examiner*—Don Wong
*Assistant Examiner*—Thuy Vinh Tran
(74) *Attorney, Agent, or Firm*—Collard & Roe, P.C.

(57) ABSTRACT

The invention relates to an antenna system for motor vehicles. This system allows mobile reception of television and radio broadcasts and of data of geostationary satellites independently of the operating condition of the vehicle. The system is for an antenna arrangement for the frequency range greater than 10 Ghz with quasi-omni-radiation in the horizontal direction.

15 Claims, 4 Drawing Sheets

ANTENNA SYSTEM

BACKGROUND OF THE INVENTION

1. Field of the Invention

The invention relates to an antenna system for motor vehicles, in particular for the reception of television and radio broadcasts and for the data transfer via geo-stationary satellites in the frequency range greater than 10 Ghz.

2. The Prior Art

For antennas for receiving transmissions from geo-stationary satellites, the elevation angle in central Europe lies at 30 degrees. Known and customarily employed satellite receiving antennas are the parabolic mirror antennas and, to a lesser extent, the planar antennas. Now, if one wanted to arrange somewhere on the body of a motor vehicle a parabolic mirror antenna with the geometry and size required for adequate gain, this would not be accepted according to current design ideas and for aerodynamic reasons.

Planar antennas are more compact; however, they are just as little suitable with their radiation lobes disposed orthogonally relative to the aperture as well. If one were to integrate a planar antenna, for example in a horizontal position in the roof of a vehicle, the direction of radiation would be wrong. If one would position it with the correct elevation, one would have the same problems as with the parabolic mirror antennas.

In addition, an antenna with directional characteristic arranged in or on the vehicle is also required to continually react to changes in the direction of radiation in accordance with the constant changes in direction occurring when the vehicle is in operation.

Antennas with directional characteristic are known from the field of radar technology where an omnidirectional radiation effect is achieved by cintinuously rotating the emitter or reflector. Such antennas combine the high, or at least adequate gain achievable with the directional effect, with an azimuth scanning of 360 degrees. The antenna, in most cases a parabolic mirror antenna, is rotated with mechanical means with a constant speed and direction.

However, said principle is not suitable for motor vehicles, in particular not for passenger cars because of the form in which the antenna is constructed. Furthermore, one needs to think of the relatively high rotational speeds at which the system would have to rotate for satellite reception, as well as of the expenditure connected therewith.

In central Europe, the reception of signals from geostationary satellites by the motor vehicle has been possible heretofore only by parking the vehicle and then extending or setting up a satellite antenna of the described type and then aligning it like a stationary antenna by hand or automatically depending on the degree of comfort offered by the equipment. This is customarily done, for example in connection with recreational motor vehicles (RV's).

SUMMARY OF THE INVENTION

The purpose of the present invention is to permit the mobile reception of television and radio broadcasts and of data of geostationary satellites independently of the operating condition of the vehicle. The invention is based on the problem of realizing for motor vehicles an antenna arrangement for the frequency range of greater than 10 Ghz with quasi-omni-radiation in the horizontal radiation diagram at an azimuth scanning of 360 degrees. The antenna arrangement is to be integrated in the structure of the vehicle in such a way that it is not visually noticeable.

Said problem is solved with the features specified in the main claim. The dependent claims contain preferred design variations and details.

By bundling a multitude of individual emitters with high packing density on a surface, the invention provides an overall compact structure. The individual emitters all have the same elevation angle, which is equal to the elevation of the overall arrangement. The required receive output is assured by a defined number of individual emitters depending on the density of the power flux, with the apertures of said emitters being added up.

With mechanical rotational motion of the arrangement, for example if all individual emitters are mounted with the same direction of radiation on a base plate intermittently moving about an axis, the number of emitters actually directed at the signal source can be equal to the total number of emitters.

With electronic rotation, groups have to be formed from the total number of emitters which, in case of reception, each supply the required gain on their own, and whose directional characteristics add up to the full circle, with a certain overlap in each case.

The basis of the direction-selective reception with intermittent change of the direction of radiation as defined by the invention are the diversity principle as well as the combined urilization of a gyromagnetic sensor and the global positioning system (GPS), by which means it is possible to detect and compensate changes in the direction of travel of the vehicle and thus the azimuth angle for the antennas with respect to a selected satellite. With the gyromagnetic sensor and with the support of the GPS-unit, a control signal for a change of the receive parameters is generated when the driving direction is changed. The diversity circuit, when the actual receive quality is reduced, additionally scans the environment of the direction of radiation and the group of emitters switched to reception, and, when the reception is falling short of a threshold value, reverses to a more favorable group of emitters. This applies to the variation of electronic rotation. With mechanical rotation, a control signal is generated for the motor of the base plate, and the system swings into the new receive direction by mechanical rotation.

The advantages of the invention are obvious: Most of all, a possibility was found for assuring a stable reception of transmissions from geostationary satellites in the moving vehicle also under conditions of low geographic elevation, for example in central Europe. The spatial dimensions of the antenna arrangement as defined by the invention are still within acceptable limits even under unfavorable conditions, i.e. low gain of the individual emitter along the edge of the supplied region and thus a high number of required emitters, and can be realized also on the average types of passenger motor vehicles. This applies even under the precondition that the system has to assure at least 30 dBi antenna gain.

A further advantage consists in that the total or overall arrangement can be divided into sectors or segments with emitter groups which are integrated in different structural parts of the body and connected via a central management. This provides for high variability of association and integration of the antenna units.

The principle as defined by the invention is shown in the present claims and exemplified embodiments in variations and details, by which the function and the advantages have already been tested and demonstrated. However, this does not mean that the idea of the invention does not also comprise further designs and variations. Conceivable is mainly also the integration in vertical elements of the body such as the side parts or, for example in a bus, the vertical arrangement behind the large-sized windowpanes inclusing the front and the rear windowpanes, where antenna systems such as the flat planar antennas switched or connected together as defined by the invention are conceivable as well. Planar antennas, which are rectangular in most cases, failed to gain successful acceptance for home use; however, they may be found to be advantageous for certain motor vehicles because of their simple construction and possible low mass.

BRIEF DESCRIPTION OF THE DRAWINGS

Other objects and features of the present invention will become apparent from the following detailed description considered in connection with the accompanying drawings. It is to be understood, however, that the drawing is designed as an illustration only and not as a definition of the limit of the invention.

DETAILED DESCRIPTION OF THE PREFERRED EMBODIMENT

Figure 1:
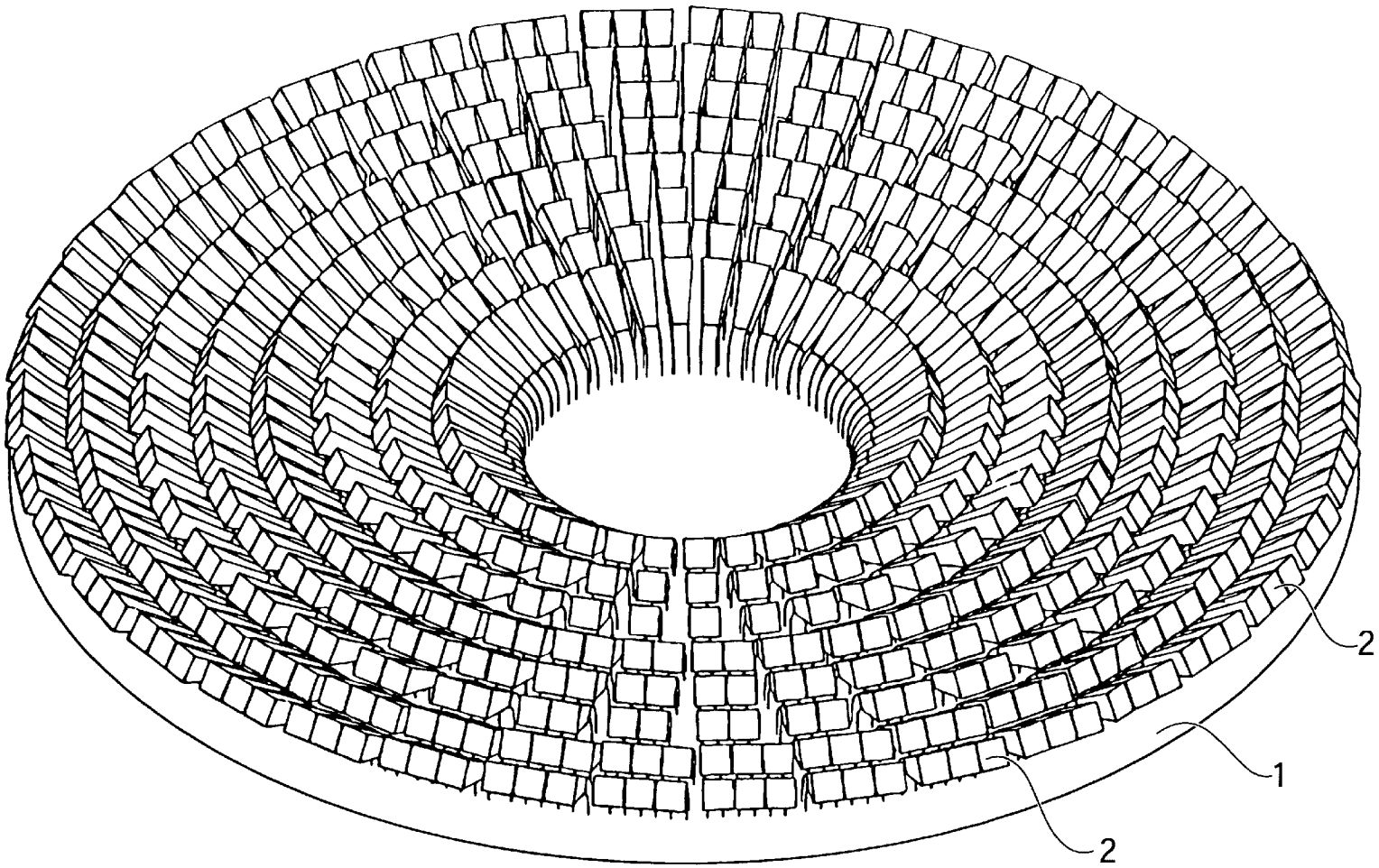
FIG. 1 shows an antenna system consisting of horn emitters on a circulr base plate, for electronic rotation.
Figure 2:
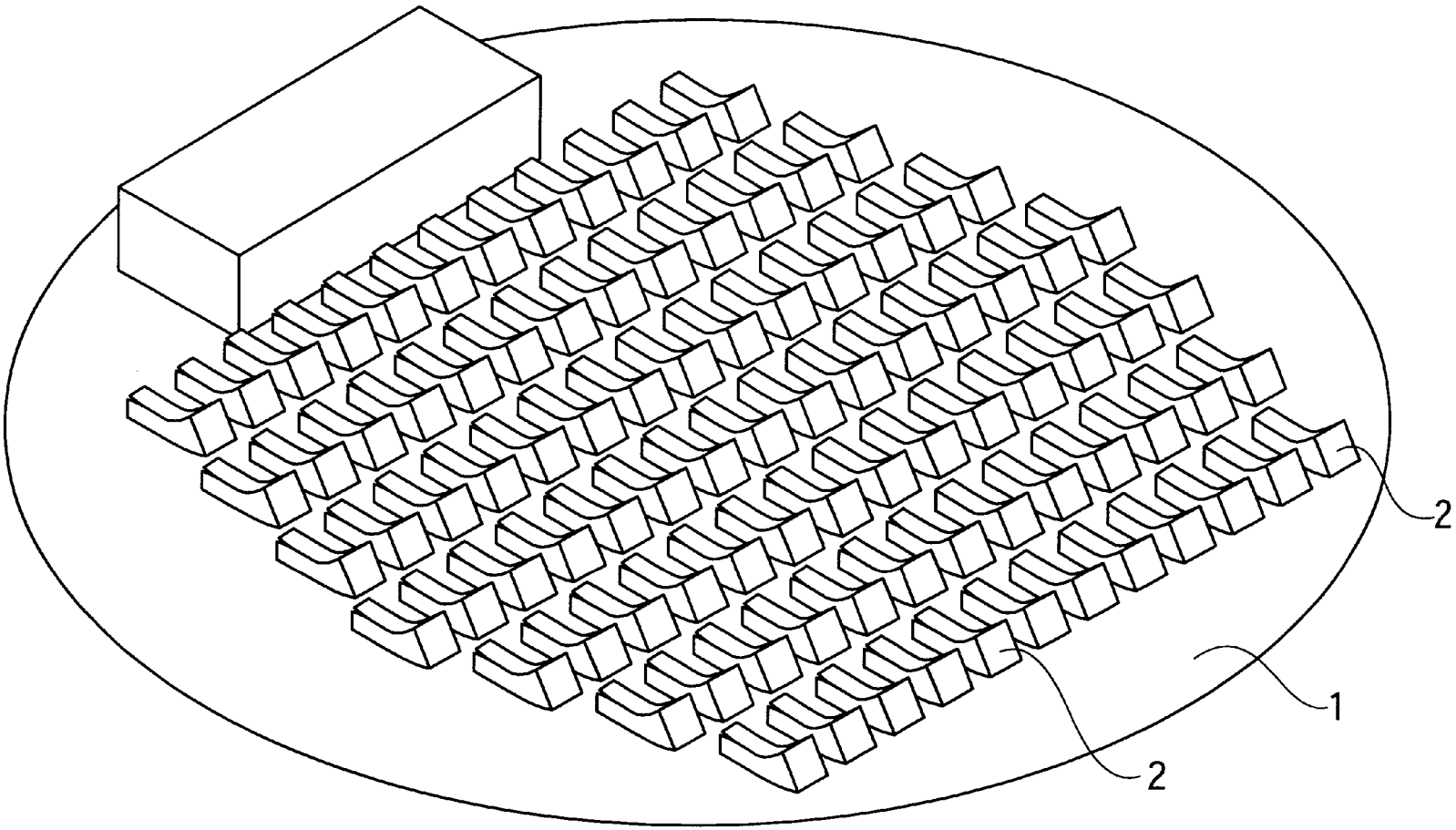
FIG. 2 shows a horn emitter on a circular base plate, for mechanical rotation.

In the schematic representation in FIGS. 1 and 2, it is assumed that the antenna systemis completely integrated as a compact structural unit in a substantially horizontal surface of the vehicle body such as, for example the roof. In FIGS. 1 and 2, the horn emitters 2 (of the pyramid horn type) are arranged on the circular base plate 1, and path antennas 3 in the example according to FIG. 3. The patch antennas are combined in groups each comprising four antennas.

With the horn-type emitters, the elevation angle of about 30 degrees is obtained by setting the funnel-like zones accordingly. With the patch antennas, the flat segments are grouped on the carriers 4, which are peripherally supported on plate 1 on the annular corrugations 5 with the cross section of a prism.

In the arrangement according to FIG. 1, the full circle is divided into reception-effective sectors with the help of the feed line network, with the lobes of said sectors overlapping each other in each case in the 3-dB range. The emitter sectors can be separated in terms of connection technology also in such a way that when the azimuth angle changes, the groups are displaced sideways by an angle smaller than the sector angle. The hollow conductors of the emitters are arranged "standing" in FIG. 1, and "lying" on base plate 1 in FIG. 2.

With the antenna system according to FIG. 2, the base plate with the emitters is mechanically driven by the drive 5. The drive has to be light, low in inertia and reliable, and the location in which it will be arranged on the body of the vehicle or on base plate 1 will depend on the premises of the individual case.

Figure 3:
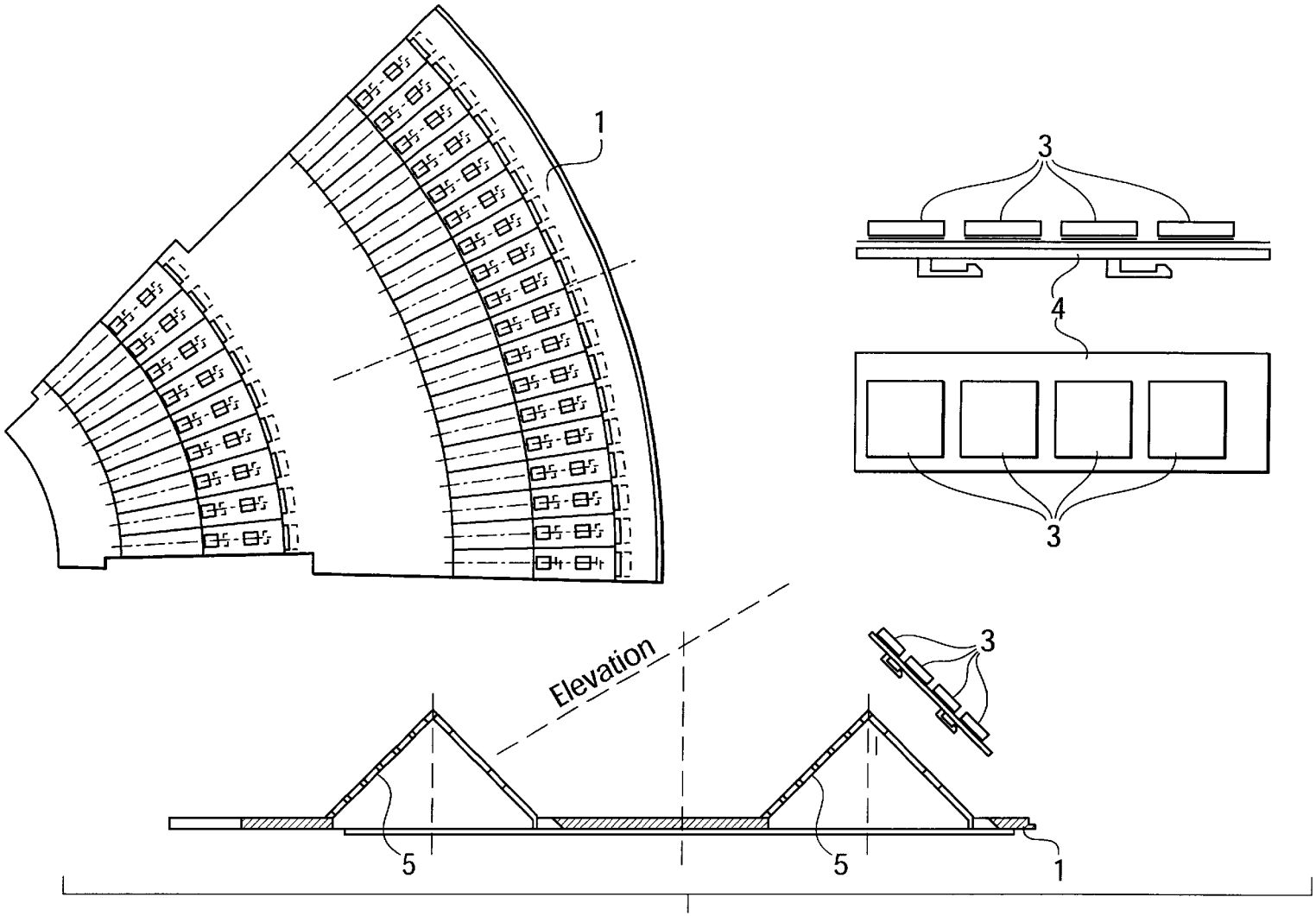
FIG. 3 shows design details of an arrangement with strip conductor antennas (patch antennas), for electronic rotation.

What has been stated above with respect to the groups and the feed line network for the exemplified embodiment according to FIG. 1 applies as well to the system with patch antennas, of which FIG. 3 shows a sector and details of the structural elements.

It is clearly shown at the same time in FIG. 3 that with electronic scanning of the azimuth, it is possible to form emitter groups which, in terms of space, are not concentrated to form a full circle. The base plate is divided into sectors with either one or several reception-effective groups in each sector, and the sectors are positioned on different elements of the body. The precondition is mainly that the fictitious omni-radiation effect is obtained again overall; that the feed line network is managable; and that no serious differences occur with respect to the running time. Said problems are solved by connecting each area sector to its own converter. Connecting the converters together at the level of the intermediate frequency can be managed in a simple way with connection technology known per se.

Figure 4:
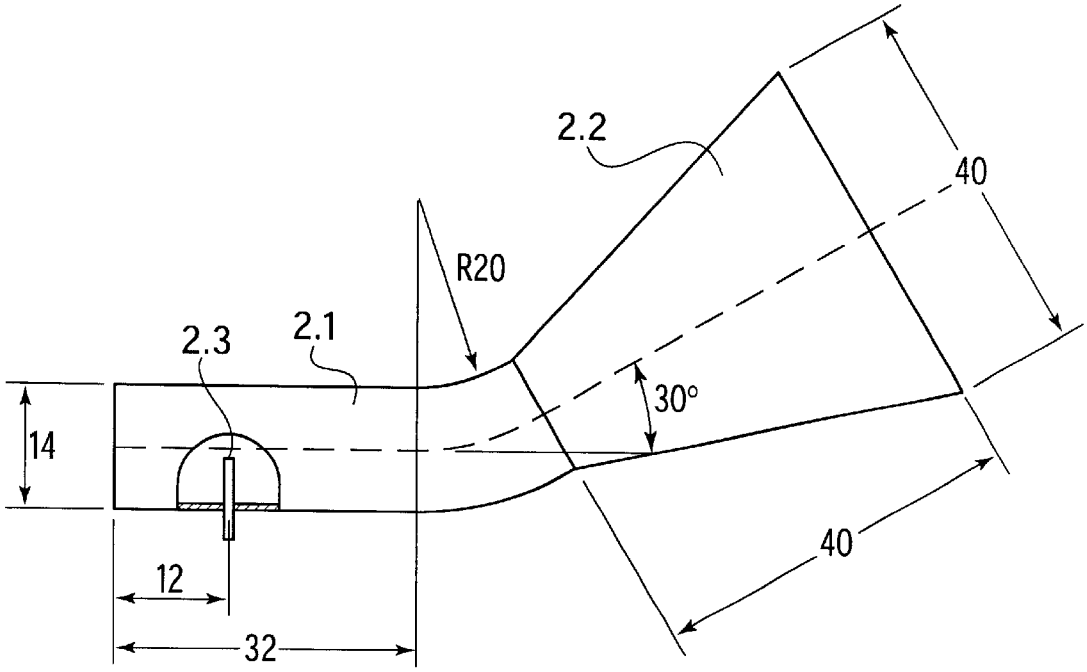
FIG. 4 is a horn emitter for 11.7 GHz.
Figure 5:
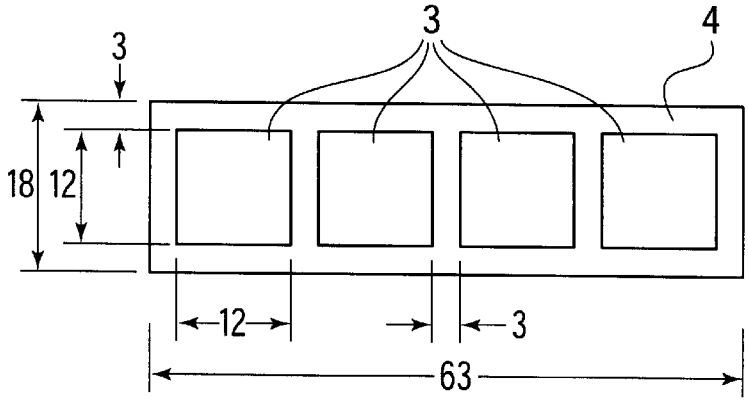
FIG. 5 shows a group of patch antennas for 11.7 GHz.

FIGS. 4 and 5 show examples for the dimensional relations of the individual emitters or an elementary group. With emitters of this structure, shown here in a simplified representation, wide-band reception is possible in one polarization in each case. The practical design itself and the selection of the materials and dimensional corrections resulting therefrom, and the physical optimization of the emitters and the system are then still decisively influenced by the space conditions, the reception spectrum and also by technological factors, which are problems which have to be solved with the means of the prior art known per se and available to the developer within the meaning of optimization of the system.

In FIG. 4, reference numerals 2.1 denote the hollow conductor conforming to 11.7 GHz; 2.2 the funnel-like widening; and 2.3 the decoupling element with tying to the feed line network.

The diameter of a base plate 1 with patch antennas having the structure described herein, and for electronic rotation comes to approximately 600 millimeters.

Accordingly, while only one embodiment of the present invention has been shown and described, it is obvious that many changes and modifications may be made thereunto without departing from the spirit and scope of the invention.

What is claimed is:

1. An antenna system in a horizontal arrangement with omni-radiation effect, for elevation angles smaller than 90 degrees in particular for the mobile reception of geostationary satellites with frequencies greater than 10 GHz, comprising:

a multitude of individual emitters (2,3) arranged on a substantially horizontal base plate (1); wherein:

(a) the direction of radiation is selected with the help of an identification of the signal source;

(b) the individual emitters (2,3) are focused by groups in a small-lobed manner to the signal source by a combined control system with gyromagnetic sensorics, GPS (global positioning system) and antenna diversity;

(c) the emitter groups are distributed over different, substantially horizontal parts of a vehicle body, and aligned in such a way that the radiation lobes of groups adjacent to each other with respect to the direction of radiation overlap one another laterally, and that an omni-characteristic is fictitiously given in the sum, wherein an own converter is associated with each separate part of the base plate with one or a plurality of groups;

(d) focusing by intermittent rotation overall comprises azimuth scanning of 360 degrees;

(e) diversity control takes place depending upon the level of the useful signal and the quality of the signal; and (f) the group of individual emitters actually focused on the signal source assures all reception parameters according to predefined quality criteria.

2. The antenna system according to claim 1, characterized by individual emitters connectable together in predetermined groups and variably into groups.

3. The antenna system according to claim 1, characterized by direction-selective reception by mechanically generated intermittent rotation preferably of all emitters (2, 3), whereby the emitters are arranged on a preferably circular base plate (1).

4. The antenna system according to claim 1, characterized by electronic rotation, for selective feeding of a changeable proportion of the individual emitters (2, 3), the latter being combined in different groups focusable on the signal source.

5. The antenna system according to claim 4, characterized by the arrangement of the individual emitters (2, 3) on a base plate (1) in concentric circles with radial radiation.

6. The antenna system according to claim 4, wherein the individual emitters (2,3) are arranged on a base plate (1) in concentric circles with radial radiation.

7. The antenna system according to claim 4, wherein the emitter groups are distributed over different, substantially horizontal parts of a vehicle body, and aligned in such a way that the radiation lobes of groups adjacent to each other with respect to the direction of radiation overlap one another laterally, and that an omni-characteristic is fictitiously given in the sum, whereby an own converter is associated with each separate part of the base plate with one or a plurality of groups.

8. The antenna system according to claim 1, characterized by horn antennas (2) as individual emitters.

9. The antenna system according to claim 1, characterized by patch antennas (3) and by elementary groups formed by such patch antennas as individual emitters.

10. The antenna system according to claim 1, characterized in that the individual emitters (2, 3) are fixed on a defined common elevation angle.

11. The antenna system according to claim 1, wherein there is direction-selective reception by mechanically generated intermittent rotation preferably of all emitters (2,3), wherein the emitters are arranged on a preferably circular base plate (1).

12. The antenna system according to claim 1, wherein there is electronic rotation, for selective feeding of a changeable proportion of the individual emitters (2,3), the latter being combined indifferent groups focusable on the signal source.

13. The antenna system according to claim 1, wherein the individual emitters are horn antennas (2).

14. The antenna system according to claim 1, wherein the individual emitters are patch antennas (3), and wherein elementary groups are formed by such patch antennas.

15. An antenna system in a horizontal arrangement with omni-radiation effect for elevation angles smaller than 90 degrees for the mobile reception of geostationary satellites with frequencies greater than 10 Ghz, comprising:

a multitude of individual emitters (2,3) arranged on a substantially horizontal base plate (1) connectable together in predetermined groups and variably into groups and said individual emitters are fixed on a defined common elevation angle and wherein:

(a) the direction of radiation is selected with the help of an identification of the signal source;

(b) the individual emitters (2,3) are focused by groups in a small-lobed manner to the signal source by a combined control system with gyromagnetic sensorics, GPS (global positioning system) and antenna diversity;

(d) focusing by intermittent rotation overall comprises azimuth scanning of 360 degrees;

(e) diversity control takes place depending upon the level of the useful signal and the quality of the signal; and (f) the group of individual emitters actually focused on the signal source assures all reception parameters according to predefined quality criteria.

* * * * *